US006225881B1

(12) United States Patent
Felden et al.

(10) Patent No.: US 6,225,881 B1
(45) Date of Patent: May 1, 2001

(54) THERMAL MAGNETIC CIRCUIT BREAKER

(75) Inventors: Walter Felden, Neumunster; Christian Thamm, Aukrug; Matthias Reichard, Neumunster; Rolf-Dieter Bauer, Raisdorf, all of (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/301,529

(22) Filed: Apr. 28, 1999

(30) Foreign Application Priority Data

Apr. 29, 1998 (DE) ..... 198 19 242

(51) Int. Cl.[7] ..... H01H 9/20; H01H 9/00
(52) U.S. Cl. ..... 335/172; 335/167
(58) Field of Search ..... 335/23–25, 35, 335/167–171

(56) References Cited

U.S. PATENT DOCUMENTS

| | | | | |
|---|---|---|---|---|
| D. 367,265 | | 2/1996 | Yamagata et al. . | |
| 2,340,682 | | 2/1944 | Powell . | |
| 2,719,203 | | 9/1955 | Gelzheiser et al. . | |
| 2,937,254 | | 5/1960 | Ericson . | |
| 3,158,717 | | 11/1964 | Jencks et al. . | |
| 3,162,739 | * | 12/1964 | Klein et al. | 335/35 |
| 3,197,582 | | 7/1965 | Norden . | |
| 3,205,325 | | 9/1965 | Archer et al. . | |
| 3,307,002 | | 2/1967 | Cooper . | |
| 3,517,356 | | 6/1970 | Hanafusa . | |
| 3,596,219 | * | 7/1971 | Erickson | 335/35 |
| 3,631,369 | | 12/1971 | Menocal . | |
| 3,803,455 | | 4/1974 | Willard . | |
| 3,883,781 | | 5/1975 | Cotton . | |
| 4,090,158 | | 5/1978 | Oeda . | |
| 4,129,762 | | 12/1978 | Bruchet . | |
| 4,144,513 | | 3/1979 | Shafer et al. . | |

(List continued on next page.)

FOREIGN PATENT DOCUMENTS

| | | |
|---|---|---|
| 819 008 | 12/1974 | (BE) . |
| 897 691 | 1/1984 | (BE) . |
| 1 227 978 | 11/1966 | (DE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |

(List continued on next page.)

*Primary Examiner*—Lincoln Donovan
*Assistant Examiner*—Triyler T. Nguyen
(74) *Attorney, Agent, or Firm*—Cantor Colburn LLP; Carl B. Horton

(57) ABSTRACT

A thermomagnetic circuit breaker in a preformed housing comprises a display means for selective display of the reasons for tripping. Tripping bars, actuable independently of one another, include a release function as well as a display function. Alternatively, display may take place with additional trip levers. Combinations of independently actuable tripping bars and an operating handle provide a display means for display of an overload, momentary, ground fault or accessory trip condition.

25 Claims, 9 Drawing Sheets

U.S. PATENT DOCUMENTS

| | | | |
|---|---|---|---|
| 4,158,119 | | 6/1979 | Krakik . |
| 4,165,453 | | 8/1979 | Hennemann . |
| 4,166,988 | | 9/1979 | Ciarcia et al. . |
| 4,220,934 | | 9/1980 | Wafer et al. . |
| 4,255,732 | | 3/1981 | Wafer et al. . |
| 4,259,651 | | 3/1981 | Yamat . |
| 4,263,492 | | 4/1981 | Maier et al. . |
| 4,276,527 | | 6/1981 | Gerbert-Gaillard et al. . |
| 4,297,663 | | 10/1981 | Seymour et al. . |
| 4,301,342 | | 11/1981 | Castonguay et al. . |
| 4,360,852 | | 11/1982 | Gilmore . |
| 4,368,444 | | 1/1983 | Preuss et al. . |
| 4,375,021 | | 2/1983 | Pardini et al. . |
| 4,375,022 | | 2/1983 | Daussin et al. . |
| 4,376,270 | | 3/1983 | Staffen . |
| 4,383,146 | | 5/1983 | Bur . |
| 4,392,036 | | 7/1983 | Troebel et al. . |
| 4,393,283 | * | 7/1983 | Masuda . |
| 4,401,872 | * | 8/1983 | Boichot-Castagne et al. . |
| 4,409,573 | * | 10/1983 | DiMarco et al. . |
| 4,435,690 | * | 3/1984 | Link et al. . |
| 4,467,297 | * | 8/1984 | Boichot-Castagne et al. . |
| 4,468,645 | * | 8/1984 | Gerbert-Gaillard et al. . |
| 4,470,027 | * | 9/1984 | Link et al. . |
| 4,479,143 | * | 10/1984 | Watanabe et al. . |
| 4,488,133 | * | 12/1984 | McClellan et al. . |
| 4,492,941 | * | 1/1985 | Nagel . |
| 4,541,032 | * | 9/1985 | Schwab . |
| 4,546,224 | * | 10/1985 | Mostosi . |
| 4,550,360 | * | 10/1985 | Dougherty . |
| 4,562,419 | * | 12/1985 | Preuss et al. . |
| 4,589,052 | * | 5/1986 | Dougherty . |
| 4,595,812 | * | 6/1986 | Tamaru et al. . |
| 4,611,187 | * | 9/1986 | Banfi . |
| 4,612,430 | * | 9/1986 | Sloan et al. . |
| 4,616,198 | * | 10/1986 | Pardini . |
| 4,622,444 | * | 11/1986 | Kandatsu et al. . |
| 4,631,625 | * | 12/1986 | Alexander et al. . |
| 4,642,431 | * | 2/1987 | Tedesco et al. . |
| 4,644,438 | * | 2/1987 | Puccinelli et al. . |
| 4,649,247 | * | 3/1987 | Preuss et al. . |
| 4,658,322 | * | 4/1987 | Rivera . |
| 4,672,501 | * | 6/1987 | Bilac et al. . |
| 4,675,481 | * | 6/1987 | Markowski et al. . |
| 4,682,264 | * | 7/1987 | Demeyer . |
| 4,689,712 | * | 8/1987 | Demeyer . |
| 4,694,373 | * | 9/1987 | Demeyer . |
| 4,710,845 | | 12/1987 | Demeyer . |
| 4,717,985 | | 1/1988 | Demeyer . |
| 4,733,211 | | 3/1988 | Castonguay et al. . |
| 4,733,321 | | 3/1988 | Lindeperg . |
| 4,764,650 | | 8/1988 | Bur et al. . |
| 4,768,007 | | 8/1988 | Mertz et al. . |
| 4,780,786 | | 10/1988 | Weynachter et al. . |
| 4,831,221 | | 5/1989 | Yu et al. . |
| 4,870,531 | | 9/1989 | Danek . |
| 4,883,931 | | 11/1989 | Batteux et al. . |
| 4,884,047 | | 11/1989 | Baginski et al. . |
| 4,884,164 | | 11/1989 | Dziura et al. . |
| 4,900,882 | | 2/1990 | Bernard et al. . |
| 4,910,485 | | 3/1990 | Bolongeat-Mobleu et al. . |
| 4,914,541 | | 4/1990 | Tripodi et al. . |
| 4,916,420 | | 4/1990 | Bartolo et al. . |
| 4,916,421 | | 4/1990 | Pardini et al. . |
| 4,926,282 | | 5/1990 | McGhie . |
| 4,935,590 | | 6/1990 | Malkin et al. . |
| 4,937,706 | | 6/1990 | Schueller et al. . |
| 4,939,492 | | 7/1990 | Raso et al. . |
| 4,943,691 | | 7/1990 | Mertz et al. . |
| 4,943,888 | | 7/1990 | Jacob et al. . |
| 4,950,855 | | 8/1990 | Bolonegeat-Mobleu et al. . |
| 4,951,019 | | 8/1990 | Gula . |
| 4,952,897 | | 8/1990 | Barnel et al. . |
| 4,958,135 | | 9/1990 | Baginski et al. . |
| 4,965,543 | | 10/1990 | Batteux . |
| 4,983,788 | | 1/1991 | Pardini . |
| 5,001,313 | | 3/1991 | Leclerq et al. . |
| 5,004,878 | | 4/1991 | Seymour et al. . |
| 5,029,301 | | 7/1991 | Nebon et al. . |
| 5,030,804 | | 7/1991 | Abri . |
| 5,057,655 | | 10/1991 | Kersusan et al. . |
| 5,077,627 | | 12/1991 | Fraisse . |
| 5,083,081 | | 1/1992 | Barrault et al. . |
| 5,095,183 | | 3/1992 | Raphard et al. . |
| 5,103,198 | | 4/1992 | Morel et al. . |
| 5,115,371 | | 5/1992 | Tripodi . |
| 5,120,921 | | 6/1992 | DiMarco et al. . |
| 5,132,865 | | 7/1992 | Mertz et al. . |
| 5,138,121 | | 8/1992 | Streich et al. . |
| 5,140,115 | | 8/1992 | Morris . |
| 5,153,802 | | 10/1992 | Mertz et al. . |
| 5,155,315 | | 10/1992 | Malkin et al. . |
| 5,166,483 | | 11/1992 | Kerusan et al. . |
| 5,172,087 | | 12/1992 | Castonguay et al. . |
| 5,178,504 | | 1/1993 | Falchi . |
| 5,184,717 | | 2/1993 | Chou et al. . |
| 5,187,339 | | 2/1993 | Lissandrin . |
| 5,198,956 | | 3/1993 | Dvorak . |
| 5,200,724 | | 4/1993 | Gula et al. . |
| 5,210,385 | | 5/1993 | Morel et al. . |
| 5,239,150 | | 8/1993 | Bolongeat-Mobleu et al. . |
| 5,260,533 | | 11/1993 | Livesey et al. . |
| 5,262,744 | | 11/1993 | Arnold et al. . |
| 5,280,144 | | 1/1994 | Bolongeat-Mobleu et al. . |
| 5,281,776 | | 1/1994 | Morel et al. . |
| 5,296,660 | | 3/1994 | Morel et al. . |
| 5,296,664 | | 3/1994 | Crookston et al. . |
| 5,298,874 | | 3/1994 | Morel et al. . |
| 5,300,907 | | 4/1994 | Nereau et al. . |
| 5,310,971 | | 5/1994 | Vial et al. . |
| 5,313,180 | | 5/1994 | Vial et al. . |
| 5,317,471 | | 5/1994 | Izoard et al. . |
| 5,331,500 | | 7/1994 | Corcoles et al. . |
| 5,334,808 | | 8/1994 | Bur et al. . |
| 5,341,191 | | 8/1994 | Crookston et al. . |
| 5,347,096 | | 9/1994 | Bolongeat-Mobleu et al. . |
| 5,347,097 | | 9/1994 | Bolongeat-Mobleu et al. . |
| 5,350,892 | | 9/1994 | Rozier . |
| 5,357,066 | | 10/1994 | Morel et al. . |
| 5,357,068 | | 10/1994 | Rozier . |
| 5,357,394 | | 10/1994 | Piney . |
| 5,361,052 | | 11/1994 | Ferullo et al. . |
| 5,373,130 | | 12/1994 | Barrault et al. . |
| 5,379,013 | | 1/1995 | Coudert . |
| 5,424,701 | | 6/1995 | Castonguary et al. . |
| 5,438,176 | | 8/1995 | Bonnardel et al. . |
| 5,440,088 | | 8/1995 | Coudert et al. . |
| 5,449,871 | | 9/1995 | Batteux et al. . |
| 5,450,048 | | 9/1995 | Leger et al. . |
| 5,451,729 | | 9/1995 | Onderka et al. . |
| 5,457,295 | | 10/1995 | Tanibe et al. . |
| 5,467,069 | | 11/1995 | Payet-Burin et al. . |
| 5,469,121 | | 11/1995 | Payet-Burin . |
| 5,475,558 | | 12/1995 | Barjonnet et al. . |
| 5,477,016 | | 12/1995 | Baginski et al. . |
| 5,479,143 | | 12/1995 | Payet-Burin . |
| 5,483,212 | | 1/1996 | Lankuttis et al. . |
| 5,485,343 | | 1/1996 | Santos et al. . |
| 5,493,083 | | 2/1996 | Olivier . |
| 5,504,284 | | 4/1996 | Lazareth et al. . |
| 5,504,290 | | 4/1996 | Baginski et al. . |

| | | | |
|---|---|---|---|
| 5,510,761 | 4/1996 | Boder et al. . | |
| 5,512,720 | 4/1996 | Coudert et al. . | |
| 5,515,018 | 5/1996 | DiMarco et al. . | |
| 5,519,561 | 5/1996 | Mrenna et al. . | |
| 5,534,674 | 7/1996 | Steffens . | |
| 5,534,832 | 7/1996 | Duchemin et al. . | |
| 5,534,835 | 7/1996 | McColloch et al. . | |
| 5,534,840 | 7/1996 | Cuingnet . | |
| 5,539,168 | 7/1996 | Linzenich . | |
| 5,543,595 | 8/1996 | Mader et al. . | |
| 5,552,755 | 9/1996 | Fello et al. . | |
| 5,581,219 | 12/1996 | Nozawa et al. . | |
| 5,604,656 | 2/1997 | Derrick et al. . | |
| 5,608,367 | 3/1997 | Zoller et al. | 335/132 |
| 5,784,233 | 7/1998 | Bastard et al. | 361/36 |
| 5,831,501 * | 11/1998 | Kolberg et al. | 335/42 |

FOREIGN PATENT DOCUMENTS

| | | |
|---|---|---|
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 651 416 A1 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 5 292 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

THERMAL MAGNETIC CIRCUIT BREAKER

BACKGROUND OF THE INVENTION

The invention relates to a thermomagnetic circuit breaker having a selective trip display.

Circuit breakers in a preformed or cast housing with thermomagnetic tripping means are well known in commercial and industrial applications. U.S. Pat. No. 3,162,739 discloses a means of this kind which has a bimetallic strip for thermal trip resulting from overload currents and a magnetic element for instantaneous trip resulting from short-circuit current surges. The tripped state is displayed by the particular position of the operating handle, as is indicated in U.S. Pat. No. 3,158,717.

A means for providing a visual display of an overload condition (reason for trip) in a thermomagnetic circuit breaker is disclosed in U.S. Pat. No. 3,883,781 and U.S. Pat. No. 5,519,561. The systems described therein use either mechanical or electrical logic information, provided by the bimetallic strip, to execute and produce a display of the overload condition. If such a device is equipped only with overload and momentary reaction elements (trip elements), a selective trip display is provided, where an instantaneous trip reaction exists when the operating handle designates the "tripped" state and the overload display system is not activated.

The increasing significance of electronic circuits as suitable devices for the display of overcurrents in electric line protective means has likewise made possible devices for distinguishing between the reasons for a trip. Printed source U.S. Pat. No. 5,485,343 describes an electronic trip unit for a circuit breaker which permits the user to determine the intensity of as well as the reason for the overcurrent condition after occurrence of the overcurrent trip. The electronic trip display for such trip information is similar to the display described in U.S. Pat. No. 4,870,531, and the control unit for such an electronic trip unit is like the trip unit described in U.S. Pat. No. 4,672,501.

In U.S. Pat. No. 3,158,717 the reason for occurrence of a disconnect condition, be it because of overload or due to a momentary overcurrent, is not indicated.

In U.S. Pat. Nos. 3,883,781 and 5,519,561, however, the devices are unable to provide a selective trip display if more than two trip elements, such as with reference to an overload, a momentary trip, a ground fault or an accessory trip (trip due to additional structural components or accessories), are provided.

The additional functions available in circuit breakers having electronic trip units, such as U.S. Pat. No. 4,870,531, however, do not always justify the additional costs for the components of electronic trip units.

Thus there is a particular need to design a thermomagnetic circuit breaker so that upon trip of the thermomagnetic circuit breaker the reason for trip is displayed in simple fashion.

BRIEF SUMMARY OF THE INVENTION

In an exemplary embodiment of the present invention, a circuit breaker comprises a circuit breaker housing having an indicator opening. A current path disposed within the circuit breaker housing connects with a protected circuit. At least one pair of separable contacts disposed within the current path connects and disconnects the protected circuit. The circuit breaker further includes an operating mechanism having a ratchet lever and an operating spring arranged for separation of the separable contacts in response to a first trip condition. External actuation of the actuation of the operating mechanism is provided by an operating handle extending through an access opening in the housing. A first trip ratchet is arranged to restrain the ratchet lever from release of the operating spring under quiescent current transferred through the current path. A second trip ratchet restrains the first trip ratchet to provide further restraint of the ratchet lever under quiescent current transferred through the current path and to release the restraint in response to the first trip condition. A first trip lever includes a first, second and third ends. The first end interacts with the second trip ratchet to remove the restraint. The second end interacts with the operating mechanism to reengage the restraint of the ratchet lever. A first trip bar, which is pivotally disposed in the circuit breaker, includes a first, second and third end. The first end releasably engages the third end of the first trip lever. The second end is selectively visible through the indicator opening. A first sensing unit interacts with the third end of the first trip bar. In response to the first trip condition, the first sensing unit pivots the first trip bar which releases the third end of the first trip lever to release the restraint to the ratchet lever. The release of the restraint separates the separable contacts and pivots the position of the second end of the first trip bar relative to the indicator opening to provide visual indication of the separation of the separable contacts.

BRIEF DESCRIPTION OF THE DRAWINGS

The invention is described below in detail by means of examples with reference to the drawing, wherein.

DETAILED DESCRIPTION OF THE INVENTION

General Design of Selective Trip Display

Figure 1:
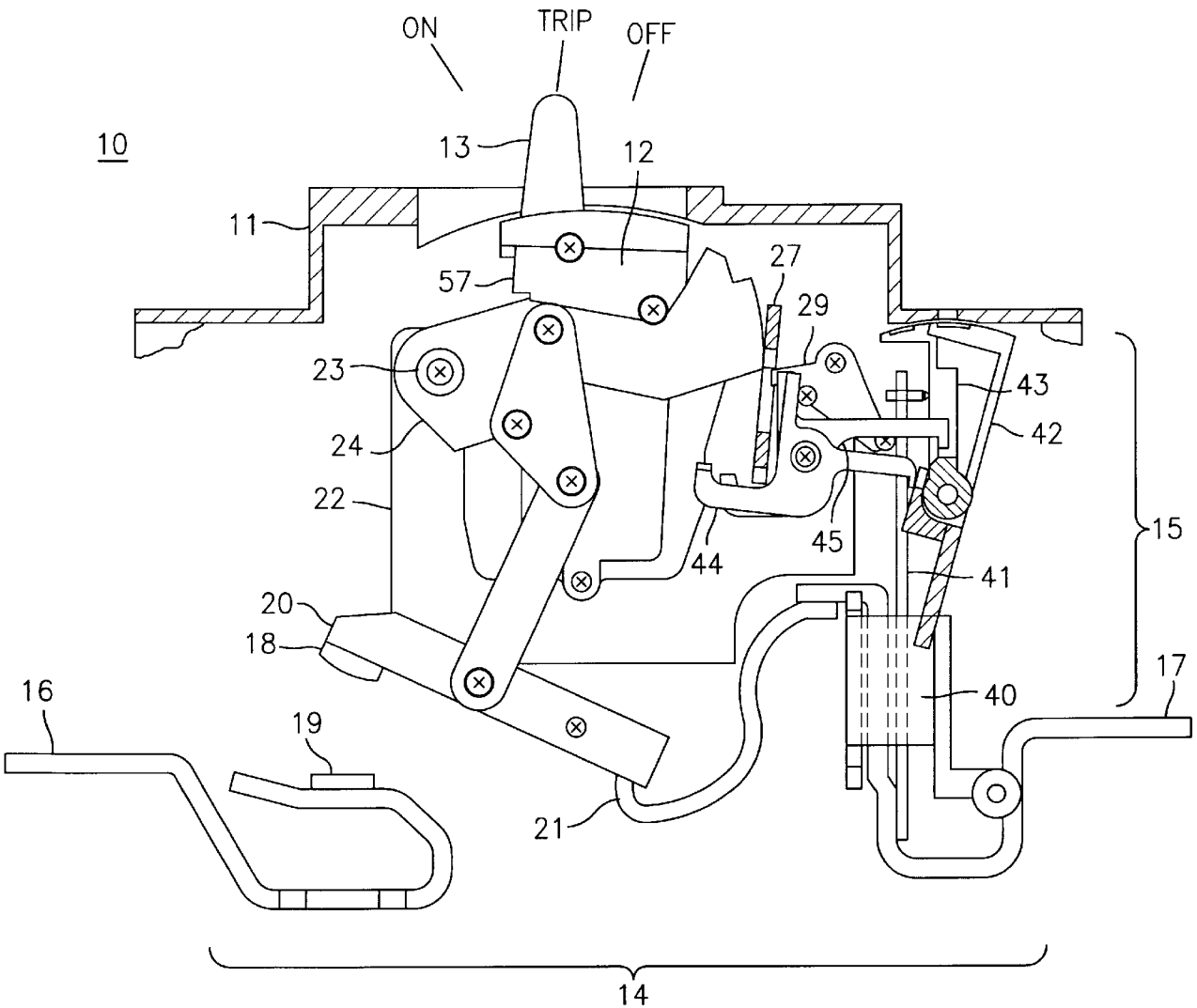
FIG. 1 is a partial sectional view of a mechanism of a multicontact thermomagnetic circuit breaker, arranged in a preformed housing, with the display of a trip resulting from a momentary overcurrent (tripped state)

A circuit breaker 10 arranged in a preformed housing is shown in FIG. 1 and consists of a housing 11, an operating mechanism 12, a control element (operating grip, handle) 13, a current path 14 and a trip unit 15. A line connection 16 and a load connection 17 of the current path 14 are connected with a protective circuit (not shown) via fastening elements (not shown). During closed circuit conditions, a movable contact 18 of a movable contact arm 20 lies on a stationary contact 19 of the line connection 16 to produce an electric current flow in the current path 14 through the line connection 16, the stationary contact 19, the movable contact 18, the movable contact arm 20, a flexible line 21 and the load connection 17.

The operating mechanism 12 works in a fashion similar to that disclosed in U.S. Pat. No. 3,158,717 and serves to open and close the movable contact arm 20.

Figure 2:
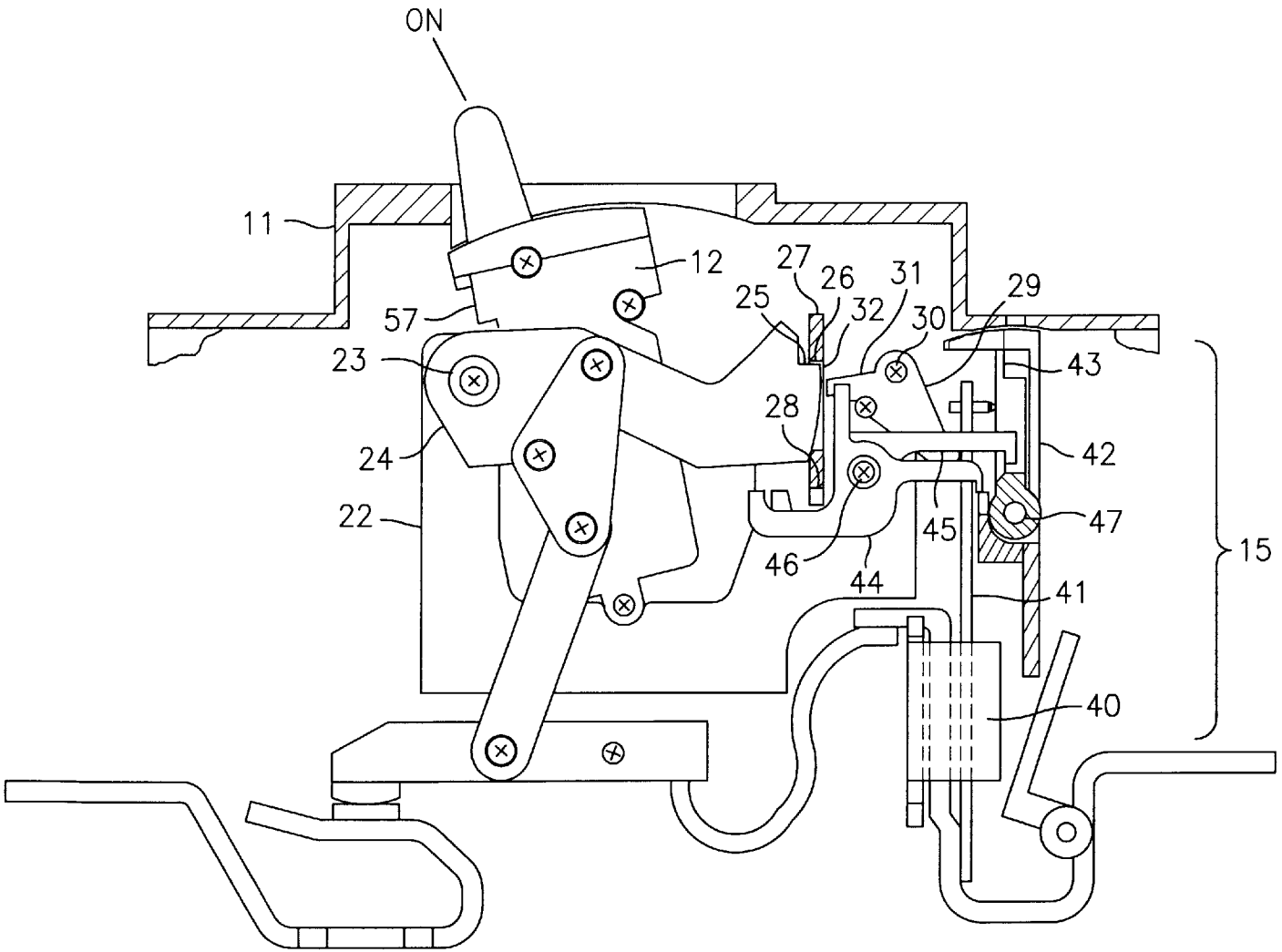
FIG. 2 is a partial sectional view of the mechanism of the multicontact thermomagnetic circuit breaker of FIG. 1 shown in an energized state.

The latched and closed state of the operating mechanism 12 is represented in FIG. 2, where a mechanical supporting member 22 in the housing 11 forms a rotary bearing 23 at one end of a ratchet lever 24. A ratchet lever surface 25 at the other end of the ratchet lever 24 opposite the bearing 23 is connected with a ratchet surface 26 of a first ratchet 27, which is seated rotary in the mechanical supporting member 22. A second ratchet 29, which is seated rotary on a rotating shaft 30 in the mechanical supporting member 22, comprises a ratchet finger 31, which cooperates with a supporting surface 32 on the first ratchet 27. The trip unit 15 consists of a momentary reaction element 40, a thermal reaction element 41, a first tripping bar 42 and a second tripping bar 43, the bars 42 and 43 being seated rotary in the housing 11 on a common rotary shaft 47. A first trip lever 44 and a second trip lever 45, which on a lever shaft 46 are arranged rotary on the mechanical supporting member 22, are in each instance arranged between the tripping bars 42 and 43 and the second ratchet 29. The mode of operation of the momentary reaction elements and the thermal reaction elements 40 and 41 within the trip unit 15 are described below with reference to FIGS. 3, 4, 5 and 6.

Reaction to Momentary Overcurrent

Figure 3:
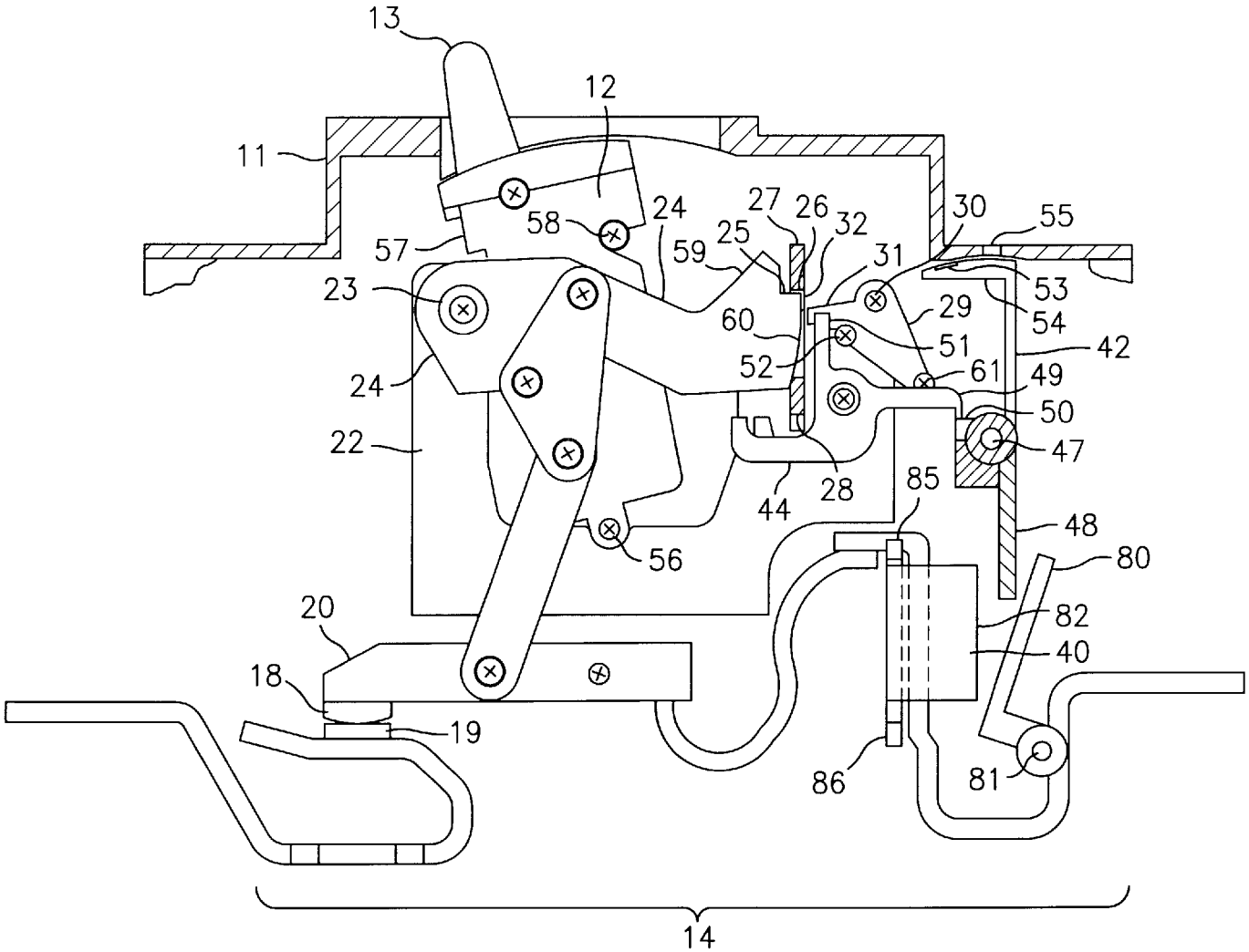
FIG. 3 is a partial sectional view of the circuit breaker of FIG. 2, in an energized state, wherein the overload and overcurrent reaction elements are omitted.
Figure 4:
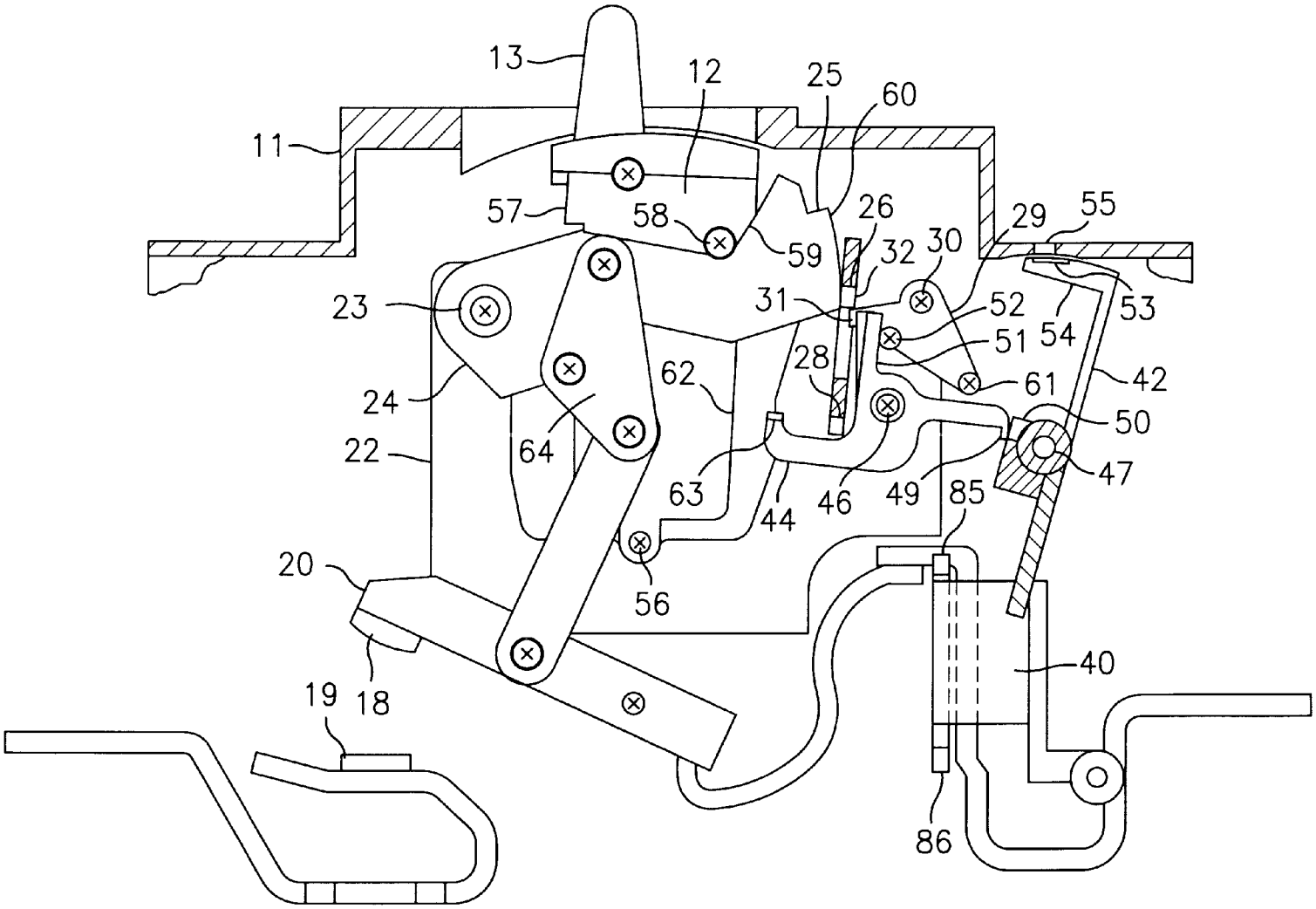
FIG. 4 is a partial sectional view of a mechanism of the multicontact thermomagnetic circuit breaker of FIG. 3 shown in a tripped state.

Operation of the momentary reaction element 40 and the mechanism 12 due to occurrence of a momentary overcurrent is explained in FIGS. 3 and 4, where the thermal reaction element 41, the second tripping bar 43 and the second trip lever 45 are omitted for the sake of better representation. Upon occurrence of a momentary overcurrent in the current path 14, an armature 80 with an armature bearing 81 is pulled up magnetically by a magnet 82, the magnet 82 being fastened in the housing 11 by means of fastening parts 85 and 86. The armature 80 cooperates with a first end 48 of the first tripping bar 42 and produces clockwise rotation of the first tripping bar 42 about the tripping bar bearing 47, owing to which a first hook 49 of the first trip lever 44 is released from the first ratchet surface of the first tripping bar 42. The first trip lever 44 is pretensioned clockwise by the use of a spring (not shown), while a first arm 51 of the first trip lever 44 is forcibly pressed against a trip pin 52 of the second ratchet 29, so that the second ratchet 29 executes a counterclockwise rotation about its bearing 30. The counterclockwise rotation of the second ratchet 29 causes the finger 31 of the second ratchet 29 to be released from the supporting surface 32 of the first ratchet 27. The pretensioning force prevailing between the ratchet lever surface 25 and the ratchet surface 26 by the use of the spring (not shown) actuating the mechanism leads to clockwise rotation of the first ratchet 27 about its bearing surface 28, whereupon the surface 25 of the ratchet lever 24 is released from the surface 26 of the first ratchet 27. If the ratchet lever surface 25 has been released from the ratchet surface 26, the mechanism behaves in a manner similar to the manner described in U.S. Pat. No. 3,158,717, in that the movable contact arm 20 is opened and the line to be protected is disconnected.

FIG. 3 shows the operating mechanism 12 in the "latched" and "closed" state, where the movable contact 18 is in contact with the stationary contact 19, while FIG. 4 shows the operating mechanism 12 in the "tripped" and "open" state, where the movable contact 18 is electrically separated from the stationary contact 19. The latched state of FIG. 3 shows a first display 53 on a second end 54 of the first tripping bar 42, which is arranged within the housing 11 at a position in which it is not visible through a first aperture 55 in the housing 11. The tripped state of FIG. 4 shows the first display 53 of the second end 54 of the first tripping bar 42 at a position within the housing 11 in which the first display 53 can be seen through the aperture 55 of the housing 11, so that a display is provided in this fashion when the movable and stationary contacts 18 and 19 of the circuit breaker are separated as the result of the reaction of the momentary reaction element 40 to a momentary overcurrent condition.

Resetting of the operating mechanism 12 and the momentary reaction element 40 to produce closing of the movable and stationary contacts 18 and 19 can be seen in FIGS. 4 and 3 (taking into consideration the reverse sequence of trip conditions according to the description above). Elimination of the momentary overcurrent condition in the current path 14 permits the armature 80 to return to its resting position shown in FIG. 3 under the pretension of a restoring spring (not shown). Clockwise rotation of the handle 13 of FIG. 4 about a handle bearing 56 of the mechanical supporting member 22, supported by a handle-supporting member 57, produces engagement of an operating pin 58 on the handle-supporting member 57 with a first cam surface 59 of the ratchet lever 24, so that the lever 24 is turned clockwise about its rotary bearing 23.

During clockwise rotation of the ratchet lever 24, a second cam surface 60 of the ratchet lever 24 comes into engagement with the first ratchet 27 until the ratchet surface 25 of the ratchet lever 24 is arranged below the ratchet surface 26 of the first ratchet 27, whereby engagement of the ratchet surface 26 with the ratchet lever surface 25 of FIG. 3 is made possible. Positioning of the ratchet surface 26 on the ratchet lever surface permits the second ratchet 29 to execute a clockwise rotation about its bearing 30 as a result of the force of a restoring spring (not shown), until a stop pin 61 is in engagement with the mechanical supporting member 22, whereby according to FIG. 3 the finger 31 of the second ratchet 29 is in engagement with the supporting surface 32 of the first ratchet 27. Clockwise rotation of the handle 13 of FIG. 4 likewise causes engagement of the resetting surface 62 of the handle-supporting member 57 with the first resetting element 63 of the first trip lever 44, whereby the first trip lever 44 is rotated counterclockwise about its lever bearing 46 and causes lifting of the first hook 49 of the first trip lever 44 above the first ratchet surface 50 of the first tripping bar 42. If the first hook 49 is located above the first ratchet surface 50, the first tripping bar 42 rotates counterclockwise about the bar bearing 47 under the force of a pre-tensioning spring (not shown), whereby according to FIG. 3 latching of the first hook 49 of the first trip lever 44 with the first ratchet surface 50 of the first tripping bar 42 is made possible. Closing of the movable contact arm 20 to bring the movable contact 18 together with the stationary contact 19 to form an electrical contact is produced by counterclockwise rotation of the handle 13 about the handle bearing 56, whereby an elbow lever connection 64 is actuated under the force of a spring (not shown) actuating the mechanism in a manner similar to the manner disclosed in U.S. Pat. No. 3,158,717, so that the movable and stationary contacts 18 and 19 are in contact (connected) with one another and the line to be protected is again closed.

Reaction to an Overload/Overcurrent

Figure 5:
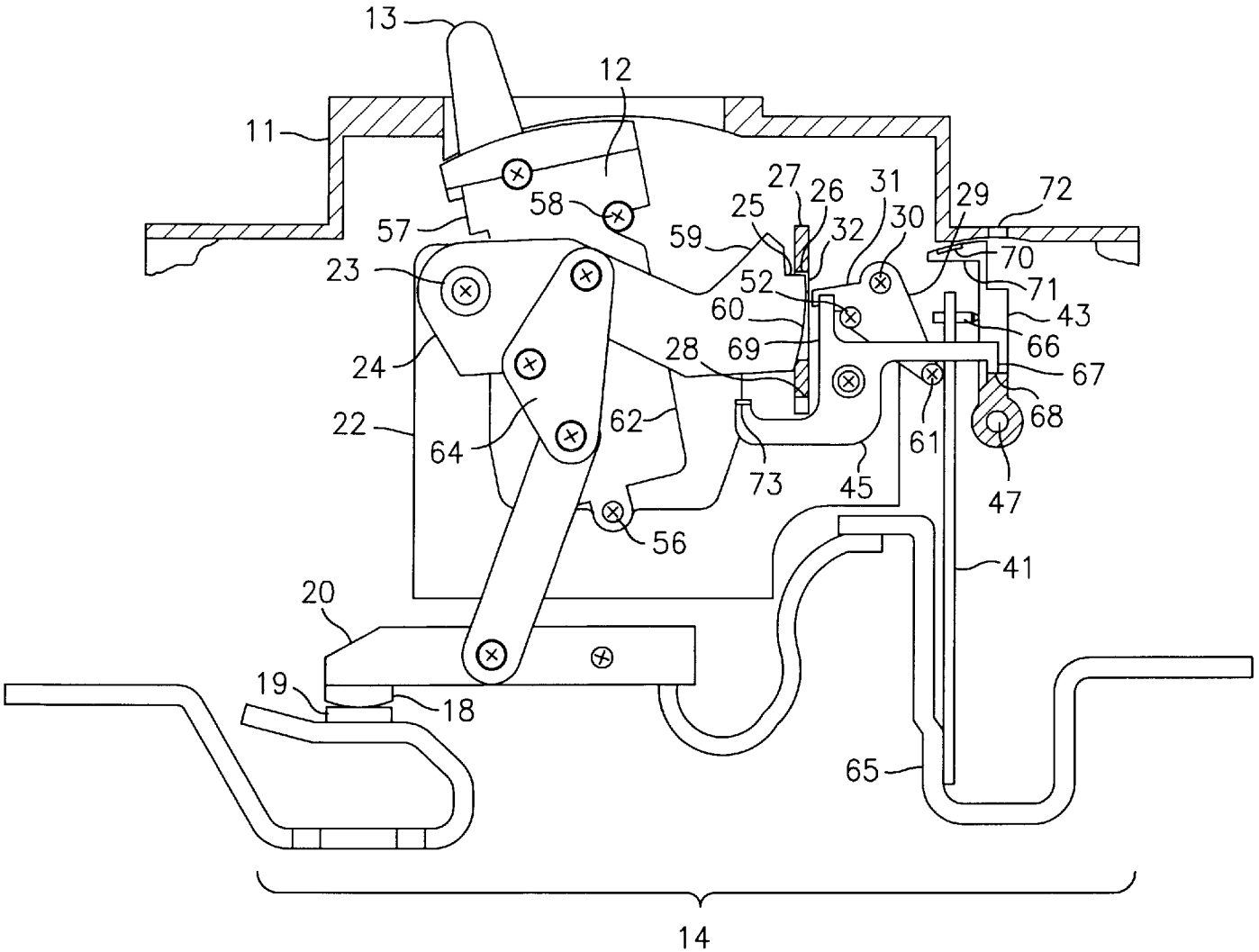
FIG. 5 is a partial sectional view of the circuit breaker in FIG. 2, where the circuit breaker is shown in an energized state and, in addition, the reaction elements for a momentary overcurrent are omitted for the sake of better representation.
Figure 6:
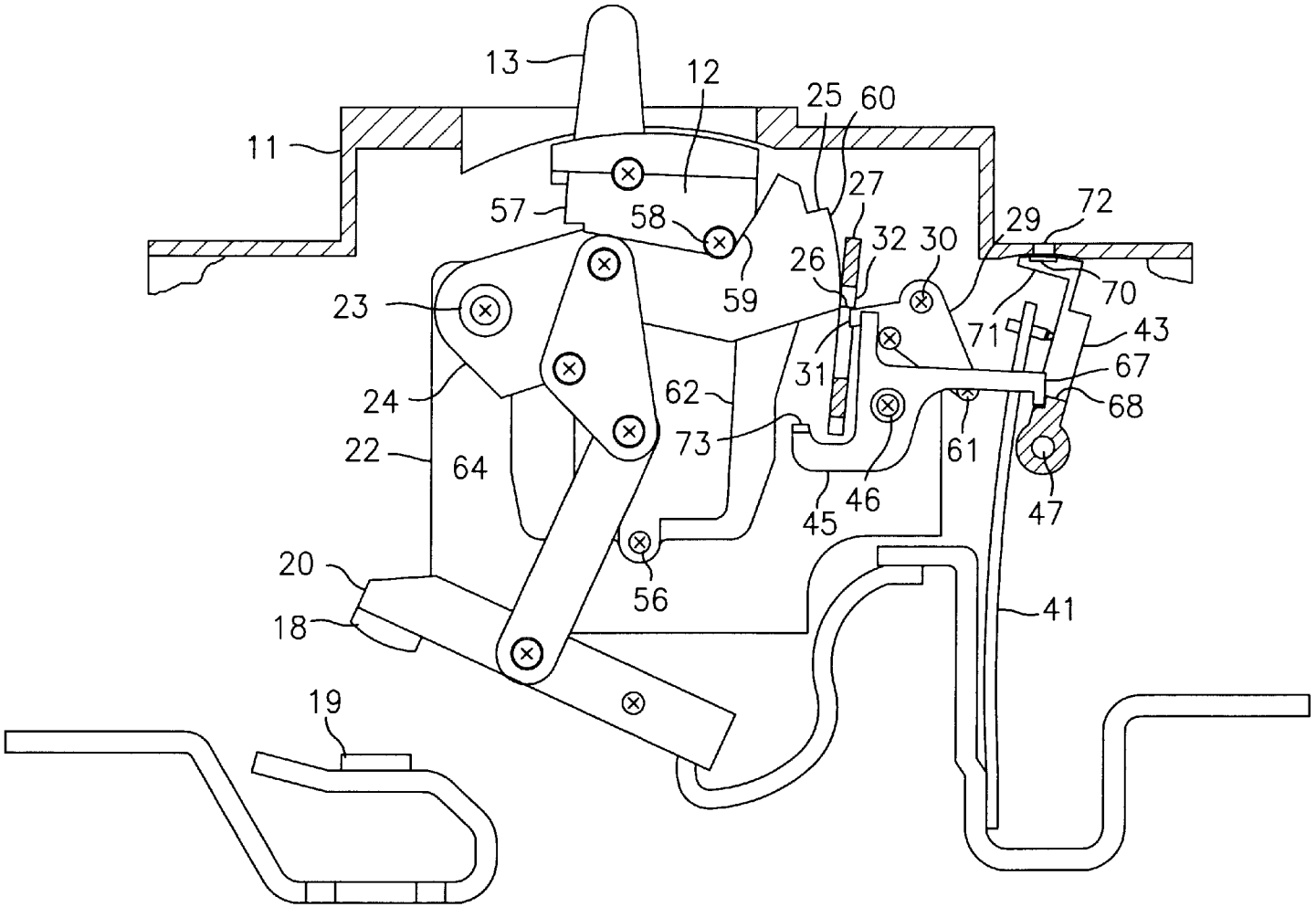
FIG. 6 is a partial sectional view of the mechanism of the multicontact thermomagnetic circuit breaker of FIG. 5 shown in a tripped state.

The mode of operation of the thermal reaction element 41 and the mechanism 12 upon occurrence of an overload/overcurrent can be described according to FIGS. 5 and 6 where, for the sake of better illustration, the momentary reaction element 40, the first tripping bar 42 and the first trip lever 44 have been omitted from the figures. After occurrence of an overload/overcurrent in the current path 14, the thermal reaction element 41, which is arranged in the current path 14 at a bend (offset piece) 65, reacts and bends clockwise about the fastening point at the bend as a result of thermal heating of the thermal reaction element 41 and the difference in the coefficient of thermal expansion of the material components forming the thermal reaction element 41, whereby an adjusting screw 66 is moved in the direction of the second tripping bar 43. Cooperation of the screw 66 with the second tripping bar 43 produces clockwise rotation of the second tripping bar 43 about the bar bearing 47, whereby a second hook 67 of the second trip lever 45 is carried away by a second ratchet surface 68 of the second tripping bar 43. By means of a spring (not shown) the second trip lever 45 is pretensioned to cause a clockwise rotation, so that a second arm 69 of the second trip lever 45 is pressed toward a trip pin 52 of the second ratchet 29 and consequently the second ratchet 29 is rotated counterclockwise about the bearing 30. Counterclockwise rotation of the second ratchet 29 causes the finger 31 of the second ratchet 29 to be released from the supporting surface 32 of the first ratchet 27 and hence to be no longer engaged. Application of a pretensioning force between the ratchet lever surface 25 and the ratchet surface 26, applied by a spring (not shown) actuating the mechanism, leads to clockwise rotation of the first ratchet 27 about bearing element 28, where the surface 25 of the ratchet lever 24 is released from the surface 26 of the first ratchet 27 and hence is no longer engaged. If the ratchet lever surface has been released from the ratchet surface 26, the operating mechanism reacts in a manner similar to the manner as described in U.S. Pat. No. 3,158,717 to open the movable contact arm 20, whereupon the line to be protected is disconnected.

FIG. 5 shows the operating mechanism 12 in the "locked" and "closed" state, in which the movable contact 18 rests on the stationary contact 19, while FIG. 6 shows the operating mechanism 12 in the "tripped" and "open" state, in which the movable contact 18 is electrically separated from the stationary contact 19. The locked state of FIG. 5 shows a second display 70 on one end 71 of the second tripping bar 43, which is arranged within the housing 11 at a position in which the display 70 is not visible through a second aperture 72 in the housing 11. The tripped state of FIG. 6 shows a second display 70 on the end 71 of the second tripping bar 43 at a position within the housing 11 in which the display 70 can be seen through the second aperture 72 in the housing 11, whereby a display is provided indicating that the movable and stationary contacts 18 and 19 of the circuit breaker are separated as a result of operation of the thermal reaction element 41 as a function of an overload/overcurrent condition.

Resetting of the operating mechanism 12 and the thermal reaction element 41 for renewed closing of the movable and stationary contacts 18 and 19 is represented in FIGS. 6 and 5 (where the reverse sequence of the trip conditions described above should be taken into account). Removal of the overload/overcurrent condition in the current path 14 permits the thermal reaction element 41 to return to its resting position shown in FIG. 5, which is produced as a result of cooling and relaxation of the internal stresses of the material components forming the thermal reaction element 41. Clock-wise rotation of the handle 13 of FIG. 6, which is supported by the handle-supporting member 57, about the handle shaft 56 of the mechanical supporting member 22 causes engagement of the operating pin 58 of the handle-supporting member 57 with the first cam surface 59 of the ratchet lever 24, so that the lever 24 is thereby rotated clockwise about its bearing 23. During clockwise rotation of the ratchet lever 24, the cam surface 60 of the lever 24 goes into engagement with the first ratchet 27, until the surface 25 of the ratchet lever 24 is arranged below the surface 26 of the first ratchet 27, whereby according to FIG. 5 latching of the ratchet surface 26 with the ratchet lever surface 25 is produced.

Positioning of the ratchet surface 26 on the ratchet lever surface 25 causes clockwise rotation of the second ratchet 29 about its bearing 30 under the force of a restoring spring (not shown) until the stop pin 61 engages with the mechanical supporting member 22, whereby the finger 31 of the second ratchet 29 engages with the supporting surface 32 of the first ratchet 27 according to FIG. 5.

Clockwise rotation of the handle 13 according to FIG. 6 likewise produces engagement of the resetting surface 62 of the handle-supporting member 57 with a second resetting element 73 of the second trip lever 45, whereby the second trip lever 45 is rotated counterclockwise about its bearing 56 and causes lifting of the second hook 67 of the second trip lever 45 above the second ratchet surface 68 of the second tripping bar 43. If the second hook 67 is located above the second ratchet surface 68, the second tripping bar 43 rotates counterclockwise about the tripping bar bearing 57 under the force of a pretensioning spring (not shown), whereby latching of the second hook 67 of the second trip lever 45 with the second ratchet surface 68 of the second tripping bar 43 according to FIG. 5 is made possible. Closing of the movable contact arm 20 to bring the movable contact 18 into contact with the stationary contact 19 is produced by counterclockwise rotation of the handle 13, the elbow lever connection 64 thereby being operated under the force of the springs (not shown) actuating the mechanism in a manner similar to the manner described in U.S. Pat. No. 3,158,717 for bringing the movable and stationary contacts 18 and 19 into contact and for renewed connection of the line to be protected.

Alternative Selective Trip Display

Figure 7:
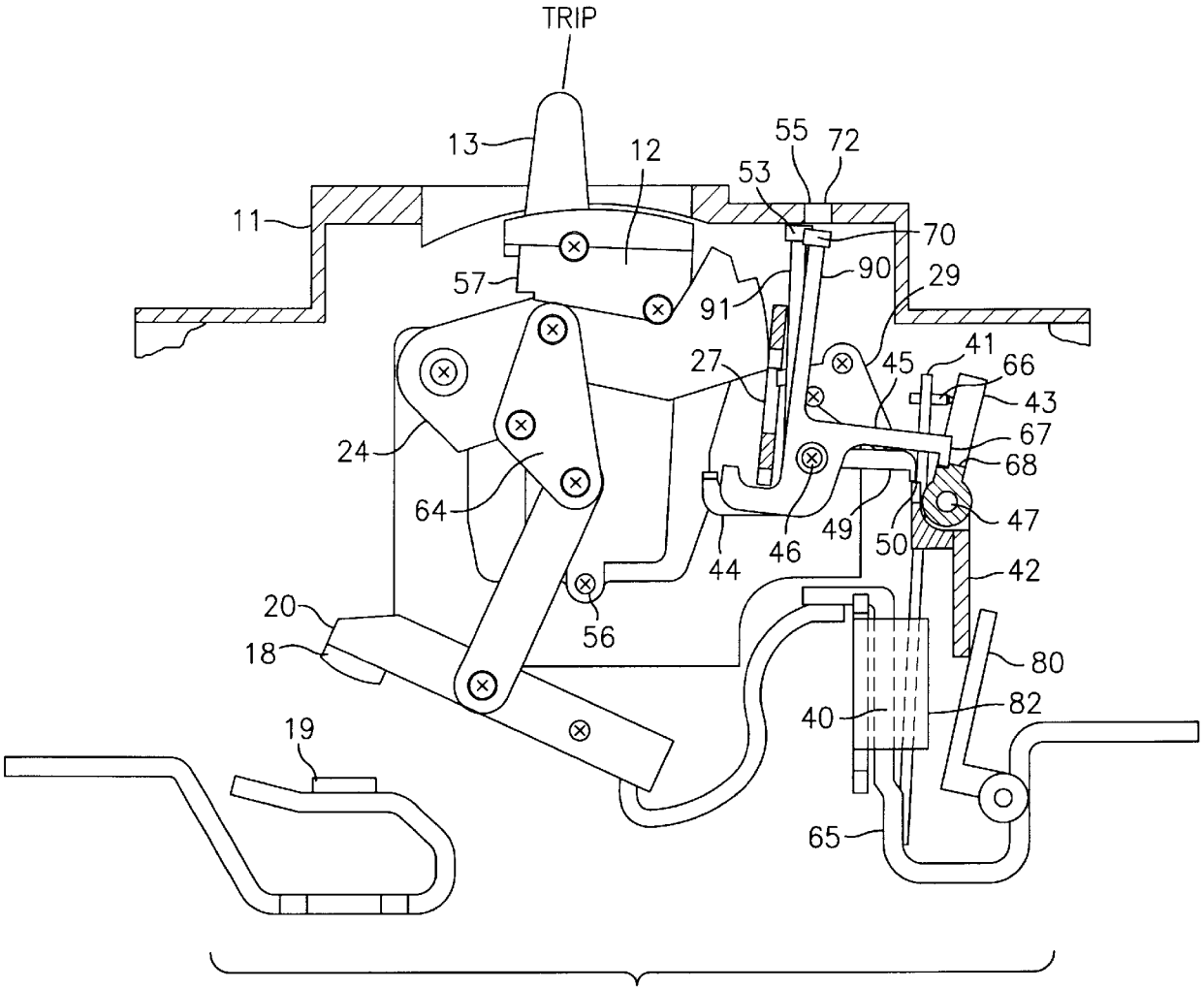
FIG. 7 is a partial sectional view of an alternative embodiment of the mechanism of a multicontact thermomagnetic circuit breaker of the present invention shown in a tripped state.

An alternative means for visual display of either a momentary or overload/overcurrent condition is shown in FIG. 7, where like reference numerals refer to like parts of FIGS. 1 to 6. FIG. 7 shows a tripped state resulting from an overload/overcurrent condition.

Overload/Overcurrent Reaction with Alternative Selective Trip Display

The mode of operation of the thermal reaction element 41 and the mechanism 12 upon occurrence of an overload/overcurrent in the alternative means shown in FIG. 7 is similar to the mode of operation described for FIGS. 5 and 6 indicated above, where an overload/overcurrent in the current path 14 causes clockwise bending (deflection) about the fastening point of the bend 65 of the thermal reaction element 41, whereby the adjusting screw 66 is moved toward the second tripping bar 43 and hence the second tripping bar 43 is rotated clockwise about the tripping bar bearing 47 to disengage the second hook 67 of the second trip lever 45 from the second ratchet surface 68 of the second tripping bar 43. A pretensioning spring (not shown) provides the force for clockwise rotation of the second trip lever 45 about the lever bearing 46 when the second hook 67 is no longer in engagement with the second ratchet surface 68. Operation of the second ratchet 29, the first ratchet 27, the ratchet lever 24, the elbow lever connection 64 and the movable contact arm 20 is produced in the fashion corresponding to the description of FIGS. 3 to 6.

The overload trip condition of FIG. 7 shows the second display 70 on the second projection 90 of the second trip lever 45 in a position within the housing 11 in which the second display 70 can be seen through the second aperture 72 of the housing, whereby a display is made provided indicating that the movable and stationary contacts 18 and 19 of the circuit breaker are separated from one another as a result of the mode of operation of the thermal reaction element 41 corresponding to an overload/overcurrent condition.

In contrast to the displays by means of the tripping bars 42 and 43 according to FIGS. 1 to 6 in conjunction with apertures in the housing 11 of the circuit breaker, according to FIG. 7 display is effected by appropriately designed trip levers 44 and 45.

Resetting of the operating mechanism 12 and the thermal reaction element 41 to produce renewed closing of the movable and stationary contacts 18 and 19 is similar to that described with reference to FIGS. 6 and 5 (where the reverse sequence of the trip conditions described should be taken into account).

Reaction to a Momentary Overcurrent with Alternative Selective Trip Display

The mode of operation of the momentary reaction element 40 and the mechanism 12 upon occurrence of a momentary overcurrent within the alternative means of FIG. 7 is the same as that described for FIGS. 3 and 4, where a momentary overcurrent in the current path 14 is produced such that the armature 80 is pulled up magnetically by magnets 82, so that the first tripping bar 42 performs a clockwise rotation about the tripping bar bearing 47 for disengaging the first hook 49 of the first trip lever 44 from the first ratchet surface 50 of the first tripping bar 42. A pretensioning spring (not shown) provides a force for rotating the first trip lever 44 clockwise about the lever bearing 46 when the first hook 49 is released from the first ratchet surface 50 and is no longer engaged. Operation of the second ratchet 29, the first ratchet 27, the ratchet lever 24, the elbow lever connection 64 and the movable contact arm 20 is produced in the same fashion as in FIGS. 3 to 6.

The overload trip condition of FIG. 7 shows that the second hook 67 of the second trip lever 45 is released from the second ratchet surface 68 of the second tripping bar 43, and the first hook 49 of the first trip lever 44 is still engaged with the first ratchet surface 50 of the first tripping bar 42. Since the first hook 49 is still engaged with the first ratchet surface 50, a first display 53 on a first projection 91 of the first trip lever 44 is arranged in a position within the housing 11 in which it cannot be seen through the first aperture 55 in the housing 11, whereby a display is provided indicating that the movable and stationary contacts 18 and 19 of the circuit breaker are not separated as a result of a reaction of the momentary reaction element 40 due to a momentary overcurrent condition. If the movable and stationary contacts 18 and 19 of the circuit breaker have been separated as a result of the reaction of the momentary reaction element 40 owing to a momentary overcurrent condition, the first hook 49 of the first trip lever 44 is released from engagement with the first ratchet surface 50 of the first tripping bar 42, whereby the first display 53 of a first projection 91 of the first trip lever 44 is arranged in a position in the housing 11 in which the first display 53 can be seen from the outside through the first aperture 55 in the housing 11.

Resetting of the operating mechanism 12 and the momentary reaction element 40 to produce renewed closing of the movable and stationary contacts 18 and 19 is the same as in the description for FIGS. 4 and 3 (where the reverse sequence of the trip conditions described should be taken into account).

Ground Fault/Accessory Tripping Means

Figure 8:
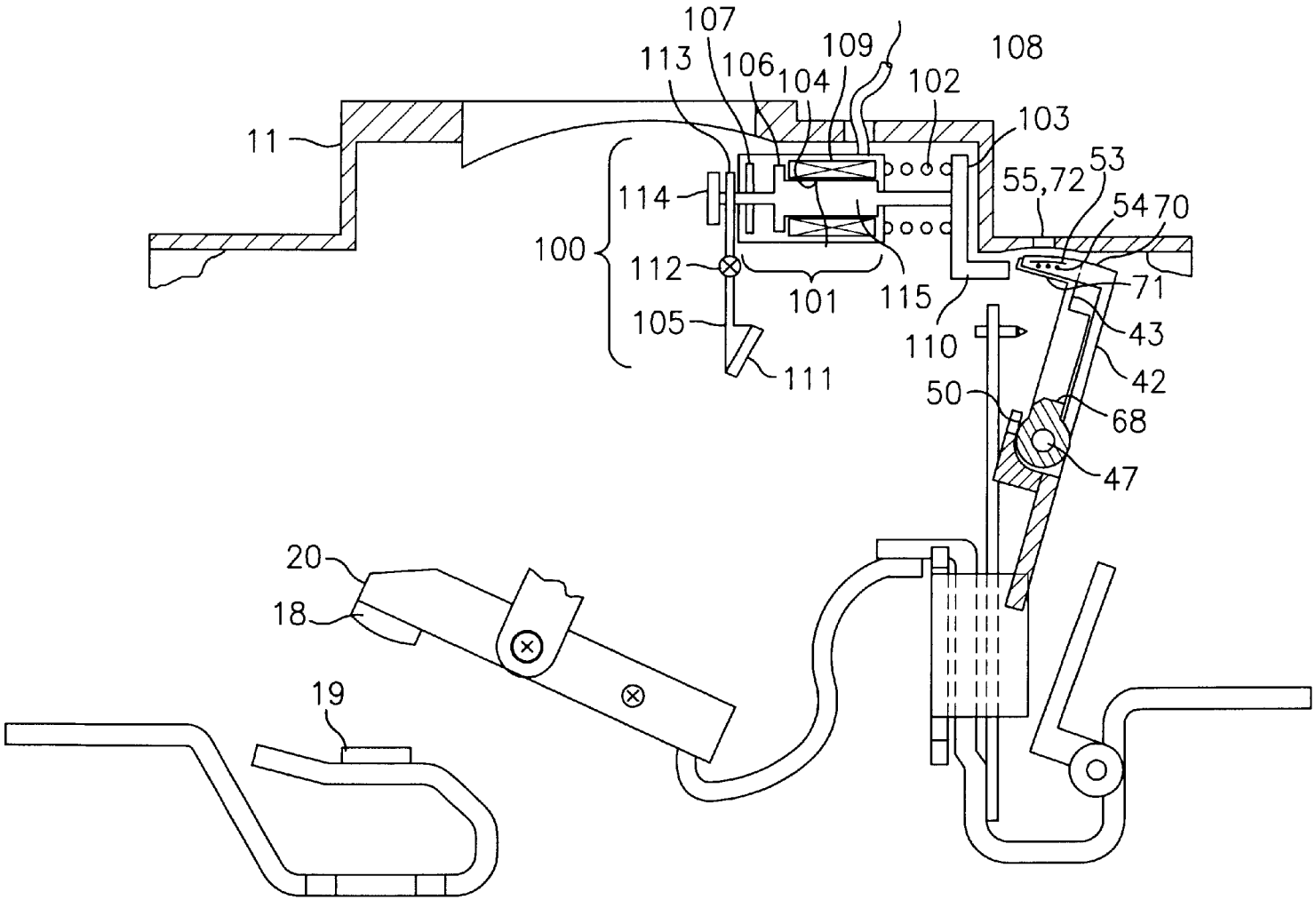
FIG. 8 is a partial sectional view of a second alternative embodiment of a multicontact thermomagnetic circuit breaker of the present invention shown in a tripped state.

The visual display of a trip condition as a result of actuation by a ground fault/accessory tripping means is shown in FIG. 8, where the ground fault/accessory tripping means 100 is arranged in the housing 11 adjacent to the arrangement of the mechanism 12 or outside the housing 11 and comprises a coil arrangement 101, a trip spring 102, a trip arm 103, a solenoid plunger arrangement 115 and a reset lever 105. In the reset state a reset plate 106 of the solenoid plunger arrangement 115 rests on a permanent magnet 107 within the coil arrangement 101, while the permanent magnet 107 exerts a sufficient retaining force on the reset plate 106 to produce a counterweight for the opposed pretensioning force of the trip spring 102. A trip signal is supplied by coil wires 108, which are electrically connected with a coil 109 in the coil arrangement 101, and permits the coil 109 to produce a magnetic field in such fashion that said magnetic field is opposed to the magnetic field of the permanent magnet 107, whereby the pulling-up force between the reset plate 106 and the permanent magnet 107 is nullified. Owing to the absence of pulling-up force between the reset plate 106 and the permanent magnet 107, the reset plate 106 is rapidly moved away from the permanent magnet 107 as a result of the pretensioning force of the trip spring 102 pressing the trip arm 103, the trip arm 103 being an integral component of the solenoid plunger arrangement 115. The reset plate 106, the solenoid plunger 104, the trip arm 103 and an end cap 114 are components of the solenoid plunger arrangement 115 and move together in unitary fashion. A rapid movement of the trip arm 103 away from the permanent magnet 107 and in the direction of the first and second tripping bars 42 and 43 results in the projecting end 110 of the trip arm 113 simultaneously striking the second end 54 of the first tripping bar 42 and the second end 71 of the second tripping bar 43 to drive the first and second tripping bars 42 and 43 clockwise about the tripping bar bearing 47, while the first and second hooks 49 and 67 (for clear representation, not shown in FIG. 8) are unlatched from the first and second ratchet surfaces 50 and 68, so that the mechanism 12 (for clear representation, not shown in FIG. 8) is actuated and the movable contact arm 20 is moved according to the description for FIGS. 3 to 6. The combined movement of the first and second tripping bars 42 and 43 leads to a first and second display 53 and 70 on the first and second tripping bars 42 and 43 and an arrangement of the same within the housing 11 in a position in which the displays 53 and 70 can be seen through the first and second apertures 55 and 72 in the housing 11, so that a display is provided indicating that the movable and stationary contacts 18 and 19 of the circuit breaker are separated as the result of a reaction of the ground fault/accessory tripping means 100 corresponding to a ground fault condition. Rapid movement of the trip arm 103 away from the permanent magnet 107 in a tripped position likewise leads to rapid movement of the end cap 114 in the same direction, since the latter likewise is an integral component of the solenoid plunger arrangement 115. In the tripped position the end cap 114 cooperates with an operating rod 113 at one end of the reset lever 105 to produce clockwise rotation about a reset lever bearing 112, whereby a reset element 111 at an opposite end of the reset lever 105 is brought into a tripped position.

Resetting of the operating mechanism 12 (FIG. 1, adjacent arrangement) and the ground fault/accessory tripping means 100 to produce renewed closing of the movable and stationary contacts 18 and 19 makes it necessary for the trip signal of the coil wires 108 to be eliminated for demagnetizing (de-energizing) the coil 109. After removal of the trip signal, rotation of the handle 13 (FIG. 1, adjacent arrangement) about the handle bearing 56 (FIG. 1), supported by the handle-supporting member 57, causes a control surface (not shown) of the handle-supporting member 57 to cooperate with the reset element 111, which extends through a dividing wall (not shown) of the housing 11 in the mechanical arrangement, and produces counterclockwise rotation of the reset lever 105 about the reset lever bearing 112. The control rod 113 of the reset lever 105 cooperates with the end cap 114 of the solenoid plunger arrangement 115 to drive the solenoid plunger arrangement 115 and the reset plate 106 in the direction of the permanent magnet 107 against the pretensioning force applied by the trip spring 102. If the reset plate 106 reaches the permanent magnet 107 and strikes it, the retaining force of the permanent magnet 107 is sufficiently great to produce a counter force to the pretensioning force of the trip spring 102, so that the solenoid plunger arrangement 115 is held in the locked position and renewed locking of the mechanism 12 (FIG. 1, mechanical arrangement) and renewed closing of the movable contact arm 20 according to the description for FIGS. 3 to 6 can follow.

Accessory Tripping Means

Figure 9:
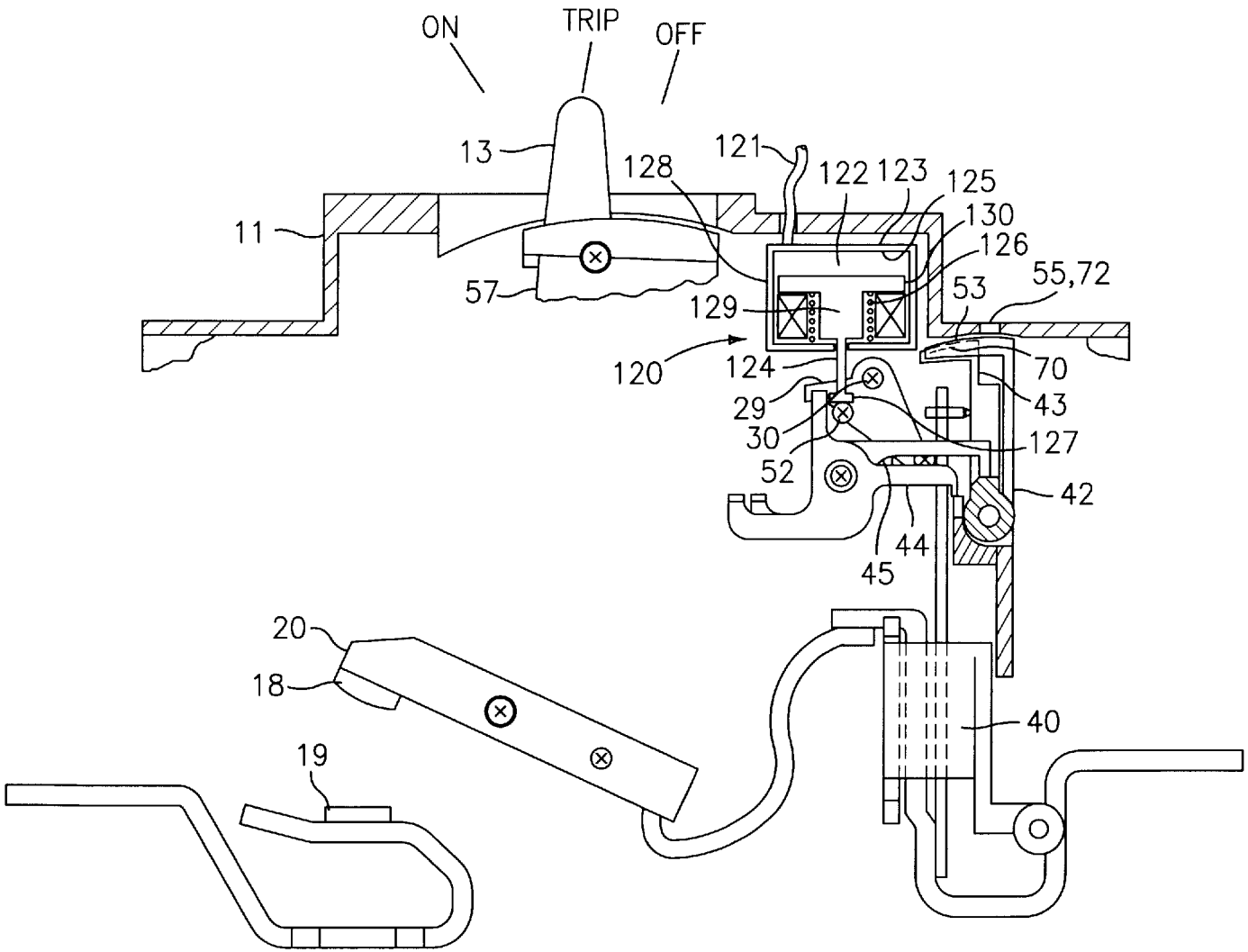
FIG. 9 is a partial sectional view of a second alternative embodiment of a multicontact thermomagnetic circuit breaker of the present invention shown in a tripped state.

Visual display of a trip condition resulting from operation of an accessory tripping means (accessory) such as an undervoltage tripping means or a working current tripping means is shown in FIG. 9, where the accessory 120 is arranged within the housing 11 in an arrangement adjacent to that of the mechanism 12 or outside the housing 11, and comprises a signaling means through coil wires 121 to receive a trip signal, a coil arrangement 122 in a coil housing 123, and a tripping solenoid plunger 124 for cooperation with the mechanism 12 shown (in FIG. 1) for the purpose of opening the movable and stationary contacts 18 and 19 corresponding to occurrence of an accessory trip signal. In the reset condition without trip signal to the coil wires 121 the tripping solenoid plunger 124 is pressed against an inner surface 125 of the coil housing 123 under the pretensioning force of a restoring spring 125 of the coil arrangement 122, whereby a separating slot is produced between a control plate 127 of the tripping solenoid plunger 124 and the trip pin 52. A trip signal to the coil wires 121, which in each instance are electrically connected with a coil 128 in the coil arrangement 122, permits the coil 128 to produce a magnetic field for exerting a magnetic pulling-up force on a solenoid plunger member 129 for pulling a solenoid plunger end 130 of the solenoid plunger member 129 of the solenoid plunger 124 and the control plate 127 downward in the direction of the pretensioning force of a restoring spring 126, so that the control plate 127 strikes the trip pin 52, which extends through a dividing wall (not shown) of the housing 11 in the direction of the accessory arrangement adjacent to the mechanical arrangement, the second ratchet 29 being rotated counter-clockwise about the bearing 30. Rotation of the second ratchet 29 is followed by operation of the first ratchet 27, the ratchet lever 24, the elbow lever connection 64 and the movable contact arm 20 in the fashion corresponding to the description referring to FIGS. 3 to 6. Since the trip condition as a result of operation of an accessory 120 does not affect the first tripping bar 42, the second tripping bar 43, the first trip lever 44 or the second trip lever 45, the positions of the first and second displays 53 and 70 remain concealed in the housing 11 and are not visible through the first and second apertures 55 and 72 of the housing 11, so that only the tripped position of the handle 13 is visible and serves to indicate that an accessory trip condition exists.

Resetting of the mechanism 12 (FIG. 1, adjacent mechanical arrangement) and the accessory 120 to produce renewed closing of the movable and stationary contacts 18 and 19 makes it necessary first for the tripping signal to the coil wires 121 for de-energizing the coil 128 to be removed. Removal of the tripping signal likewise removes the magnetic field generated by means of the coil 128, whereby the magnetically generated tripping force is nullified as counter force to the force of the restoring spring 126, so that the spring 126 cooperates with the solenoid plunger end 130 to lift the solenoid plunger member 129, the tripping solenoid plunger 124 and the control plate 127 until the solenoid plunger end 130 stops at the inner surface 125 of the coil housing 123 and the control plate 127 is released from the trip pin 52 to form a separating slot between the control plate 127 and the trip pin 52. If the separating slot has been formed between the control plate 127 and the trip pin 52, the handle 13 supported by the handle-supporting member 57 can be rotated clockwise about the handle bearing 56 (FIG. 1, adjacent mechanical arrangement) to produce renewed latching of the mechanism 12 and renewed closing of the movable contact arm 20 according to the description referring to FIGS. 3 to 6.

The thermomagnetic circuit breaker in a preformed housing therefore comprises a display means for the selective display of reasons for trip. Tripping bars operable independently of one another provide a trip function as well as a display function. Alternatively, a display may be effected with additional trip levers. Combinations of independently operable tripping bars and an operating handle provide a display means for the display of an overload, momentary, ground fault or accessory trip condition.

Various modification in structure or steps or function of the disclosed invention may be made by one skilled in the art without departing from the scope of the claims.

What is claimed is:

1. A circuit breaker comprising:

a circuit breaker housing having an indicator opening;

a current path within said circuit breaker housing;

a pair of separable contacts mounted within said circuit breaker housing, said pair of separable contacts within said current path;

an operating mechanism within said circuit breaker housing, said operating mechanism arranged to separate said separable contacts;

a first trip ratchet arranged to restrain said operating mechanism from separating said separable contacts during quiescent current transfer through said current path;

a second trip ratchet arranged to restrain said first trip ratchet from releasing said operating mechanism during quiescent current transfer through said current path;

a first trip lever including first, second and third ends, said first end interacting with said second trip ratchet to remove said restraint of said first trip ratchet, said second end interacting with said operating mechanism to engage said restraint of said first trip ratchet on said operating mechanism;

a first trip bar pivotally disposed in said circuit breaker, said first trip bar including first, second and third ends, said first end of said first trip bar releasably engaging said third end of said first trip lever, said second end of said first trip bar selectively visible through said indicator opening; and a first sensing unit interacting with said third end of said first trip bar, said first sensing unit in response to a first trip condition pivots said first trip bar to release said third end of said first trip lever thereby urging said first end of said first trip lever to interact with said second trip ratchet thereby urging said second trip ratchet to remove said restraint of said first trip ratchet to release restraint on said operating mechanism to separate said separable contacts and pivots the position of said second end of said first trip bar relative to said indicator opening to provide visual indication of the separation of said separable contacts.

2. The circuit breaker of claim 1 further comprising:

a second trip lever including first, second and third ends, said first end interacting with said second trip ratchet to remove said restraint of said first trip ratchet, said second end interacting with said operating mechanism to engage said restraint of said first trip ratchet on said operating mechanism;

a second trip bar pivotally disposed in said circuit breaker, said second trip bar including first, second and third ends, said first end of said second trip bar releasably engaging said third end of said second trip lever, said second end of said second trip bar selectively visible through said indicator opening; and a second sensing unit interacting with said third end of said second trip bar, said second sensing unit in response to a second trip condition pivots said second trip bar to release said third end of said second trip lever thereby urging said first end of said second trip lever to interact with said second trip ratchet thereby urging said second trip ratchet to remove said restraint of said first trip ratchet to release restraint on said operating mechanism to separate said separable contacts and pivots the position of said second end of said second trip bar relative to said indicator opening to provide visual indication of the separation of said separable contacts.

3. The circuit breaker of claim 1 wherein said first trip condition includes an instantaneous overcurrent.

4. The circuit breaker of claim 2 wherein said second trip condition includes a long time overcurrent.

5. The circuit breaker of claim 2 wherein said second trip condition includes a short time overcurrent.

6. The circuit breaker of claim 1 wherein said first sensing unit includes a magnet and an armature, said armature interacting with said third end of said first trip bar, wherein said armature is magnetically responsive to said magnet in response to said first trip condition.

7. The circuit breaker of claim 2 wherein said second sensing unit is thermally responsive to said second trip condition.

8. The circuit breaker of claim 1 wherein said second end of said first trip bar includes first indicia visible through said indicator opening.

9. The circuit breaker of claim 2 wherein said second end of said first trip bar includes first indicia visible through said indicator opening; and said second end of said second trip bar includes second indicia visible through said indicator opening.

10. The circuit breaker of claim 2 wherein a response element disposed in said circuit breaker housing is arranged to engage both said first and second trip bars, to actuate said operating mechanism to separate said separable contacts in response to a third trip condition.

11. The circuit breaker of claim 10 wherein said response element comprises a solenoid to engage said first bar and said second trip bar.

12. The circuit breaker of claim 11 wherein said third trip condition is an earth leakage condition.

13. The circuit breaker of claim 10 wherein both second ends of said first trip bar and said second trip bar are visible through said indicator opening in response to said third trip condition.

14. The circuit breaker of claim 2 wherein a response element within said circuit breaker housing is arranged to actuate said second trip ratchet to separate said separable contacts in response to a fourth trip condition, wherein neither second ends of said first trip bar and said second trip bar are visible through said indicator opening in response to said third trip condition.

15. The circuit breaker of claim 14 wherein said fourth trip condition is an accessory trip condition.

16. The circuit breaker of claim 14 wherein said response element comprises a solenoid to engage said second trip ratchet.

17. A circuit breaker comprising:

a circuit breaker housing having an indicator opening;

a current path within said circuit breaker housing;

a pair of separable contacts mounted within said circuit breaker housing, said pair of separable contacts within said current path;

an operating mechanism within said circuit breaker housing, said operating mechanism arranged to separate said separable contacts;

a first trip ratchet arranged to restrain said operating mechanism from separating said separable contacts during quiescent current transfer through said current path;

a second trip ratchet arranged to restrain said first trip ratchet from releasing said operating mechanism during quiescent current transfer through said current path;

a first trip lever including first, second and third ends, said first end interacting with said second trip ratchet to remove said restraint of said first trip ratchet and selectively visible through said indicator opening, said second end interacting with said operating mechanism to engage said restraint of said first trip ratchet on said operating mechanism;

a first trip bar pivotally disposed in said circuit breaker, said first trip bar including first and second ends, said first end of said first trip bar releasably engaging said third end of said first trip lever; and a first sensing unit interacting with said second end of said first trip bar, said first sensing unit in response to a first trip condition pivots said first trip bar to release said third end of said first trip lever thereby urging said first end of said second trip lever to interact with said second trip ratchet thereby urging said second trip ratchet to remove said restraint of said first trip ratchet to release restraint on said operating mechanism to separate said separable contacts and pivots the position of said first end of said first trip lever relative to said indicator opening to provide visual indication of the separation of said separable contacts.

18. The circuit breaker of claim 17 further comprising:

a second trip lever including first, second and third ends, said first end interacting with said second trip ratchet to remove said restraint of said first trip ratchet and selectively visible through said indicator opening, said second end interacting with said operating mechanism to engage said restraint of said first trip ratchet on said operating mechanism;

a second trip bar pivotally disposed in said circuit breaker, said second trip bar including first, second and third ends, said first end of said second trip bar releasably engaging said third end of said second trip lever; and a second sensing unit interacting with said second end of said second trip bar, said second sensing unit in response to a second trip condition pivots said second trip bar to release said third end of said second trip lever thereby urging said first end of said second trip lever to interact with said second trip ratchet thereby urging said second trip ratchet to remove said restraint of said first trip ratchet to release restraint on said operating mechanism to separate said separable contacts and pivots the position of said first end of said second trip lever relative to said indicator opening to provide visual indication of the separation of said separable contacts.

19. The circuit breaker of claim 17 wherein said first trip condition includes an instantaneous overcurrent.

20. The circuit breaker of claim 18 wherein said second trip condition includes a long time overcurrent.

21. The circuit breaker of claim 18 wherein said second trip condition includes a short time overcurrent.

22. The circuit breaker of claim 17 wherein said first sensing unit includes a magnet and an armature, said armature interacting with said third end of said first trip bar, wherein said armature is magnetically responsive to said magnet in response to said first trip condition.

23. The circuit breaker of claim 18 wherein said second sensing unit is thermally responsive to said second trip condition.

24. The circuit breaker of claim 17 wherein said second end of said first trip lever includes first indicia visible through said indicator opening.

25. The circuit breaker of claim 18 wherein said second end of said first trip lever includes first indicia visible through said indicator opening; and said second end of said second trip lever includes second indicia visible through said indicator opening.

* * * * *